US006231018B1

(12) United States Patent
Barbieri

(10) Patent No.: US 6,231,018 B1
(45) Date of Patent: May 15, 2001

(54) GUITAR HANGER

(76) Inventor: Mark Barbieri, 2511 Woodbine Rd., Aliquippa, PA (US) 15001

( * ) Notice: Subject to any disclaimer, the term of this patent is extended or adjusted under 35 U.S.C. 154(b) by 0 days.

(21) Appl. No.: 09/283,711

(22) Filed: Apr. 1, 1999

(51) Int. Cl.[7] ..... A47H 1/16
(52) U.S. Cl. ..... 248/302; 84/327; 248/304
(58) Field of Search ..... 248/302, 303, 248/304, 110, 112, 113; 84/267, 327

(56) References Cited

U.S. PATENT DOCUMENTS 5,372,346 * 12/1994 Upchurch et al. ..... 248/312 X
5,911,396 * 6/1999 Bireley ..... 248/340
5,941,490 * 8/1999 Pearse ..... 248/302

* cited by examiner

*Primary Examiner*—Ramon O. Ramirez
(74) *Attorney, Agent, or Firm*—Matthew B. Dernier, Esq.

(57) ABSTRACT

A guitar hanger includes a base member operable to attach to a substantially vertically oriented plane, the base member forming an aperture with the plane; and a hanger member including two spaced apart substantially longitudinally disposed rods, the rods having respective ends terminating at a coupling portion and respective distal ends defining an opening region for receiving a guitar neck, wherein the coupling portion is operable to engage the aperture such that the hanger member removably connects to the base member, the rods extending outward from the plane when the coupling portion engages the aperture.

23 Claims, 5 Drawing Sheets

GUITAR HANGER

BACKGROUND OF THE INVENTION

1. Field of the Invention

The present invention relates to a guitar hanger and, more particularly, the present invention relates to a wall mount guitar hanger in which a hanger portion thereof may be removably attached to a base portion such that the hanger portion may be transported.

2. Related Art

With reference to FIG. 1, typical wall-type guitar hangers include a plate portion 1 and a pair of rods 2, 4 extending from the plate portion 1. The plate portion is mounted to a wall using known fastening elements (not shown). The rods 2, 4 are spaced apart and extend from the plate portion 1 such that a guitar neck may be disposed between the rods 2, 4 and hang in a substantially vertical orientation.

FIG. 2 illustrates a conventional guitar stand 6 which is disposed on the floor and cradles the body of a guitar in spaced apart arms 7, 8.

Unfortunately, the wall guitar hangers and floor guitar stands are disadvantageous because, among other things, they cannot be easily transported. Indeed, the wall guitar hanger (FIG. 1) is not easily removed from a wall once it is attached thereto. Although the guitar stand 6 is not mounted to the floor and may be moved, it is relatively large and cannot, for example, be placed in a guitar case and transported to another location.

Those skilled in the art understand that it is desirable to have a means for hanging or supporting one's guitar no matter where one utilizes his guitar. It is also desirable that the means for mounting the guitar be compact and portable, preferably being stored with other gear and not requiring additional effort to move.

Accordingly, there is a need in the art for a new guitar hanger which overcomes the disadvantages of prior art guitar mounting devices.

SUMMARY OF THE INVENTION

In order to overcome the disadvantages of the prior art, the guitar hanger of the present invention includes a base member operable to attach to a substantially vertically oriented plane, the base member forming an aperture with the plane; and a hanger member including two spaced apart substantially longitudinally disposed rods, the rods having respective ends terminating at a coupling portion and respective distal ends defining an opening region for receiving a guitar neck, wherein the coupling portion is operable to engage the aperture such that the hanger member removably connects to the base member, the rods extending outward from the plane when the coupling portion engages the aperture.

Preferably, the base member includes a substantially U-shaped opening and ends operable to attach to the plane, the opening substantially facing the plane when the base member is attached thereto such that the aperture is formed. In use, the base member is operable to attach to the plane such that the aperture is substantially vertically oriented, the coupling member being upwardly insertable into and through the aperture from below the aperture.

Preferably, at least the rods are formed from a formable material such that they may be bent by hand to conform to the guitar neck.

Other objects, features and advantages of the present invention will become apparent from the following description of the invention which refers to the accompanying drawing.

BRIEF DESCRIPTION OF THE DRAWING

For the purposes of illustrating the invention, there are shown in the drawing forms which are presently preferred, it being understood, however, that the invention is not limited to the precise arrangements and instrumentalities shown.

DETAILED DESCRIPTION OF THE INVENTION

Figure 3:
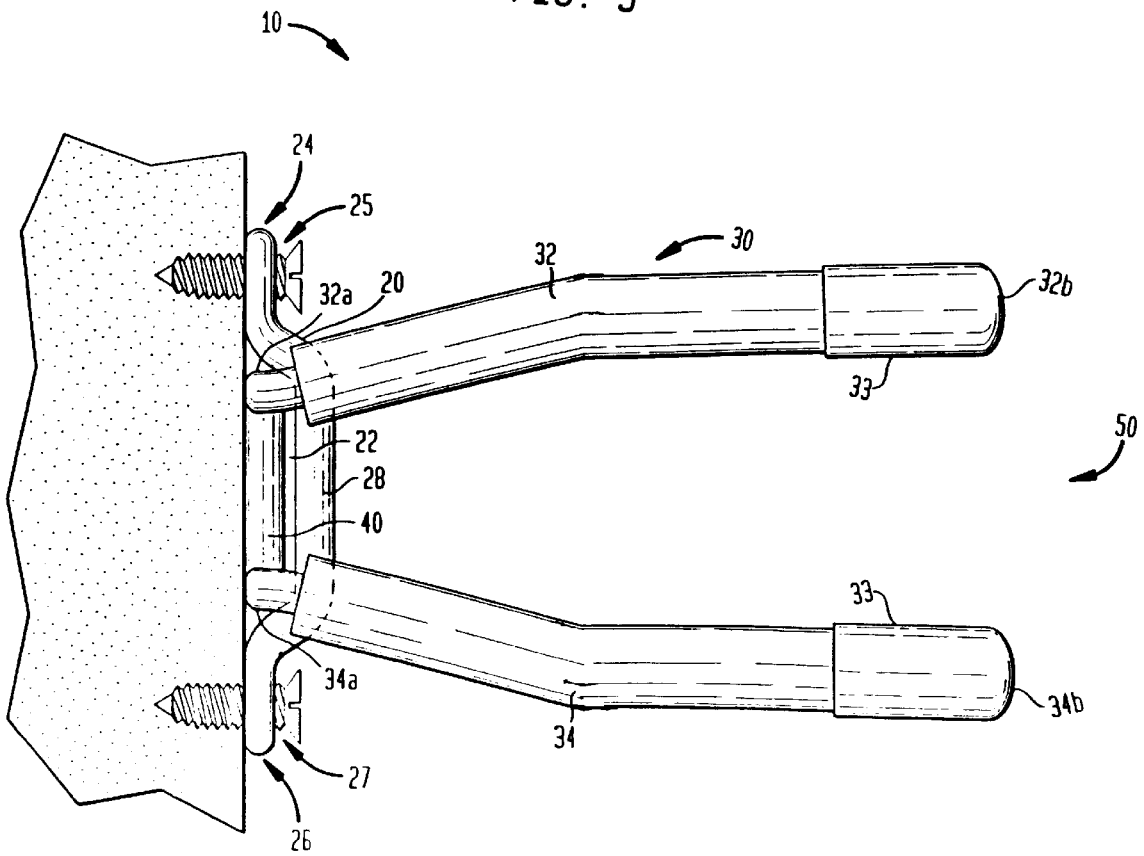
FIG. 3 is a top view illustrating the guitar hanger of the present invention.
Figure 4:
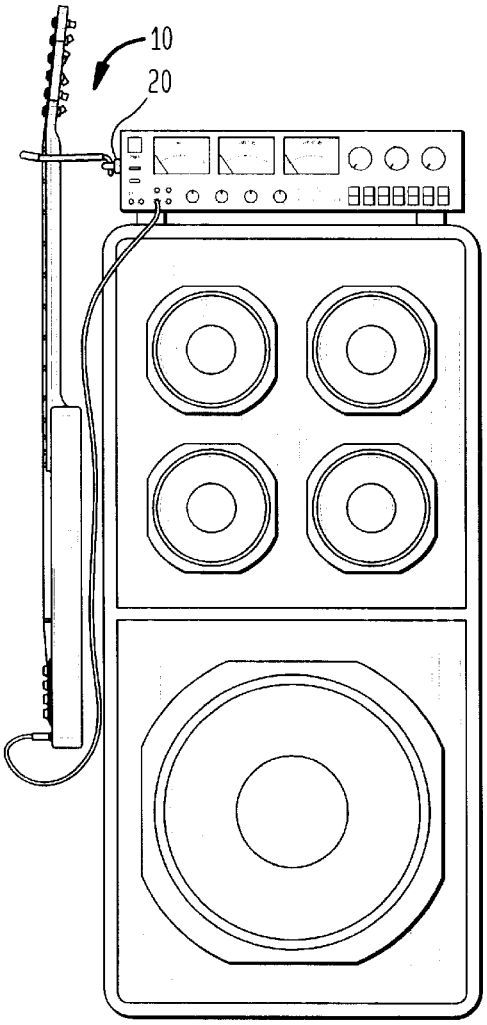
FIG. 4 illustrates the guitar hanger of FIG. 3 in use.
Figure 5:
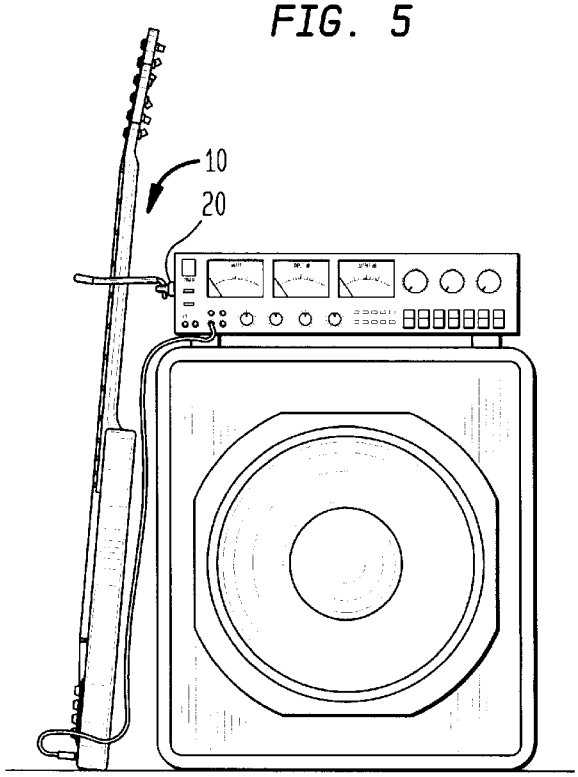
FIG. 5 illustrates an alternative use of the guitar hanger of FIG. 3.

Referring to the drawing wherein like numerals indicate like elements, there is shown in FIG. 3 a guitar hanger 10 according to the present invention. The guitar hanger 10 includes a base member 20 and a hanger member 30. FIG. 4 illustrates the guitar hanger 10 in use. In particular, the guitar hanger 10 is mounted to the side of an electric amplifier, for example, the amplifier to which the guitar is electronically connected. The base member 20 is preferably attached to a vertically oriented plane, such as a wall or the side of another object (FIGS. 4 and 5). As best seen in FIG. 5 the guitar does not need to hang from the hanger 30, but may be supported thereby so that it does not easily fall over.

Referring to FIG. 3, the base member 20 preferably includes a substantially U-shaped opening 22 and ends 24, 26 sized and shaped to attach to the vertically oriented plane. In use, ends 24 and 26 attach to the vertically oriented plane such that the U-shaped opening 22 faces the plane and forms a vertically oriented aperture.

It is most preferred that the base member include an engagement bar 28 extending between the ends 24, 26 and defining at least a portion of the aperture.

The base member includes at least one fastener 25, 27 located at each end 24, 26 respectively. It is most preferred that the fasteners be screws extending through eyelets at each end 24, 26 of the base member. Those skilled in the art will appreciate that other fasteners may be employed, such as bolts, rivets, nails, adhesives, hooks, welds, cables, clamps, lugs, and/or pins.

The hanger 30 preferably includes two spaced apart rods 32, 34 which are substantially longitudinally disposed. Each rod includes an end 32*a*, 34*a*, respectively, terminating at a coupling portion 40. Each rod 32, 34 also includes a distal end 32*b*, 34*b*, respectively, defining an opening region 50 for receiving a guitar neck.

Figure 6A:
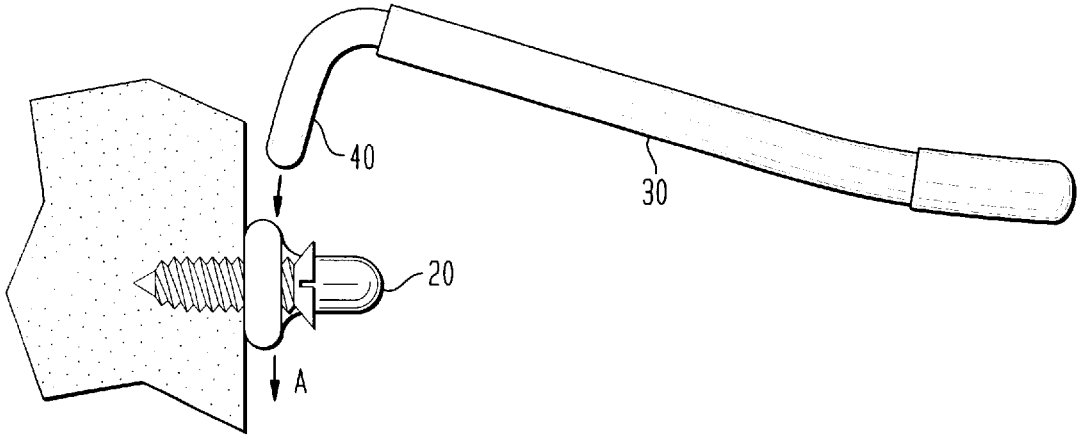
FIGS. 6A, 6B, and 6C are side views illustrating the removable feature of the guitar hanger of FIG. 3.
Figure 6B:
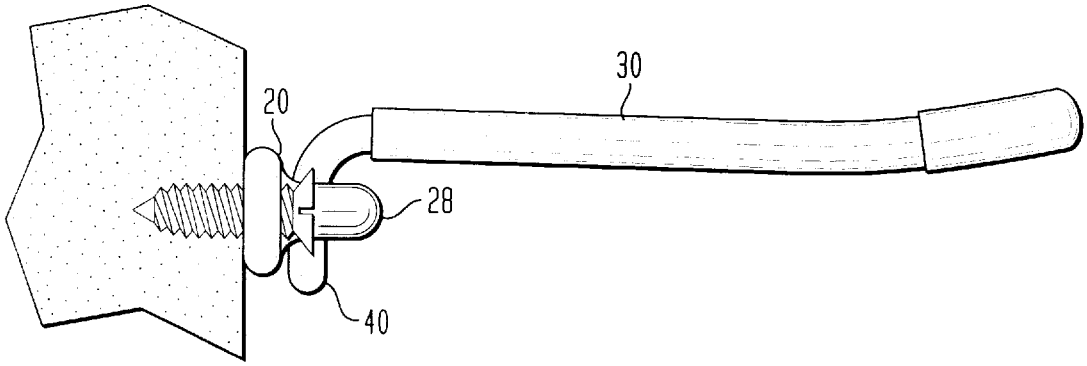
Figure 6C:
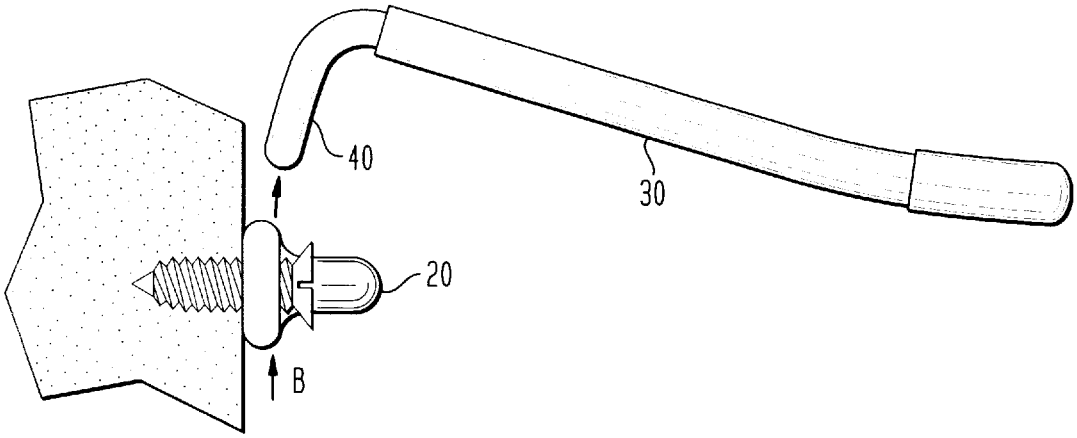
Figure 7:
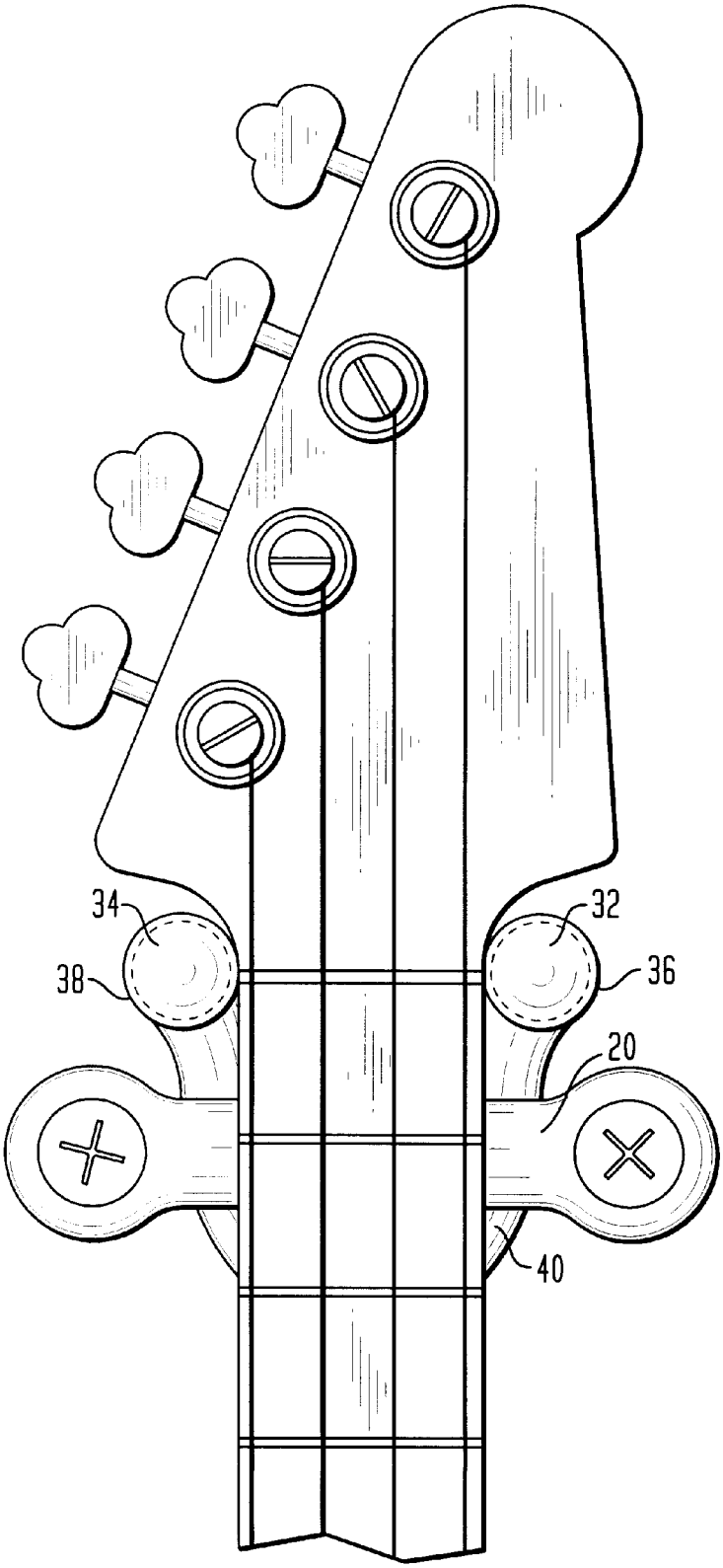
FIG. 7 is a front view illustrating the guitar hanger of FIG. 3 in use.

The coupling portion 40 is sized and shaped to engage the aperture formed by the base portion 20 such that the hanger member 30 removably connects to the base member 20. With reference to FIGS. 6A–6C, the coupling portion 40 and base member 20 are sized and shaped such that the coupling portion 40 may be and/or upwardly insertable into and through the aperture formed by the base member 20 from above. It is preferred that the coupling portion 40 be downwardly insertable (see arrow A, FIG. 6A). Thus, when the guitar neck is inserted between the rods 32, 34 and applies a force downwardly on the rods, the coupling member 40 is biased against the engagement bar 28 of the base member 20 and ensures support of the guitar (FIG. 6B). The hanger 30 may be removed from the base member 20 by lifting the hanger 30 and extracting the coupling member 40 (arrow B, FIG. 6C). FIG. 7 shows a guitar supported by the hanger 30.

As best seen in FIGS. 6A–6C, with the rods 32, 34 lying in a first plane, the coupling portion 40 forms a protrusion lying in a second plane, where the second plane is transverse with respect to the first plane. Most preferably, the second plane defined by the coupling portion 40 is substantially perpendicular with respect to the first plane defined by the rods 32, 34 (FIG. 7).

It is most preferable that the protrusion of the coupling portion 40 be formed by a transversely disposed loop extending from one end 32*a* of rod 32 to one end 34*a* of rod 34. The loop is preferably U-shaped and integrally formed with the rods 32, 34.

Preferably, the rods 32, 34 are formed from a formable (i.e., bendable) material such that they may be bent by hand to conform to the particular dimensions of the user's guitar. Suitable materials for forming the rods 32, 34 are metal (such as stainless steel and aluminum), plastic, and/or composite materials of plastic and metal.

Cushion members 36, 38 (FIG. 7) may be disposed on each of the rods 32, 34 to protect the neck of the guitar from damage by the rods 32, 34. Preferably, the cushion members 36, 38 are formed of polymer sleeves which surround the rods 32, 34. Those skilled in the art will appreciate that other materials and configurations may be used in obtaining the cushion members 36, 38.

End caps 33 may be disposed over each distal end 32*b*, 34*b* to provide additional protection to the guitar, with plastic end caps being most preferred.

It has been found that a footmen loop measuring approximately three inches long is a suitable device for use as the base member 20. Preferably, such a footmen loop would employ an engagement bar 28 which is spaced from the vertical plane by approximately 0.3 to 0.5 inches. It has also been found that stainless steel dowel having a diameter of about 0.3 inches is suitable for forming the hanger member 30.

Figure 1:
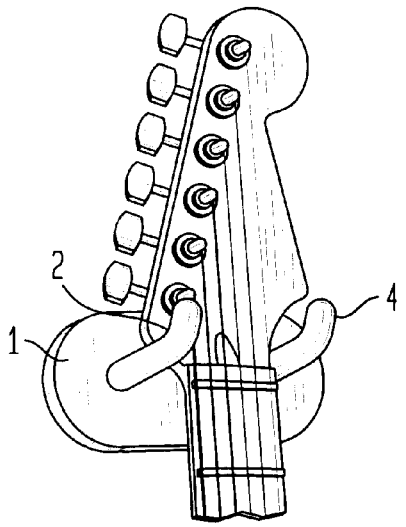
FIG. 1 (PRIOR ART)
FIG. 1 illustrates a wall guitar hanger of the prior art.
Figure 2:
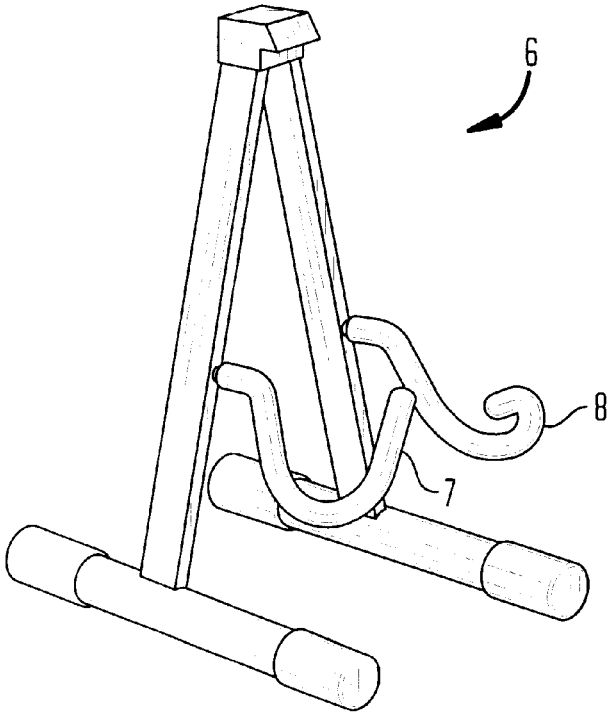
FIG. 2 (PRIOR ART)
FIG. 2 illustrates a guitar stand of the prior art.

As best seen in FIGS. 6A–6C and 7, in use, the rods 32, 34 extend substantially horizontally outward from the vertical plane to engage the neck of the guitar. It has been found that rods, 32, 34 measuring from about 4 inches to about 5 inches are particularly useful in receiving guitar necks of various manufacturers. These measurements are critical when portability is important. Indeed, the hanger portion 30 may be disposed in a guitar case and transported without additional effort, unlike the guitar stand of the prior art (FIG. 2).

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A guitar stand, comprising:

a base member operable to attach to a substantially vertically oriented plane, the base member including a substantially U-shaped opening and ends operable to attach to the plane, the opening substantially facing the plane when the base member is attached thereto such that an aperture is formed with the plane; and a hanger member including two spaced apart substantially longitudinally disposed rods, the rods having respective ends terminating at a coupling portion and respective distal ends defining an opening region for receiving a guitar neck, wherein the coupling portion is operable to engage the aperture such that the hanger member removably connects to the base member, the rods extending outward from the plane when the coupling portion engages the aperture.

2. The guitar stand of claim 1, wherein the ends of the base member include fasteners for attaching the base member to the plane the fasteners being taken from the group consisting of screws, bolts, rivets, nails, adhesives, hooks, welds, cables, clamps, lugs, and pins.

3. The guitar stand of claim 1, wherein at least the rods are formed from a formable material such that they may be bent by hand to conform to the guitar neck, the formable material being taken from the group consisting of metal, steel, aluminum, plastic, and composite.

4. The guitar stand of claim 1, further comprising cushion members disposed on each of the rods for engaging the guitar neck, the cushion members being formed of polymer sleeves which surround the rods.

5. The guitar stand of claim 1, wherein the coupling portion forms a protrusion extending transversely with respect to a plane defined by the rods, the protrusion being receivable into the aperture of the base member.

6. The guitar stand of claim 5, wherein the protrusion is formed by a transversely disposed loop extending from one end of one rod to one end of the other rod.

7. The guitar stand of claim 6, wherein the rods lie in a first plane, the loop lies in a second plane, and the first plane is transversely oriented with respect to the second plane.

8. The guitar stand of claim 6, wherein the loop is integrally formed with the rods.

9. The guitar stand of claim 6, wherein the loop is substantially U-shaped.

10. The guitar stand of claim 5, wherein the base member is operable to attach to the plane such that the aperture is substantially vertically oriented, the protrusion being at least one of upwardly and downwardly insertable into and through the aperture.

11. The guitar stand of claim 10, wherein the base member includes an engagement bar spaced away from the plane and defining at least a portion of the aperture, the protrusion being biased against the engagement bar when downward force is applied to the distal ends of the rods.

12. The guitar stand of claim 1, wherein the rods are about five inches long and are spaced apart by about 2 inches.

13. A guitar stand, comprising:

a base member operable to attach to a substantially vertically oriented plane, the base member forming an aperture with the plane; and a hanger member including two spaced apart substantially longitudinally disposed rods, the rods having respective ends forming a protrusion extending transversely with respect to a planed defined by the rods and terminating at a coupling portion, and the rods having respective distal ends defining an opening region for receiving a guitar neck, wherein the coupling portion is operable to engage the aperture such that the hanger member removably connects to the base member, the rods extending outward from the plane when the coupling portion engages the aperture.

14. The guitar stand of claim 7, wherein the protrusion is formed by a transversely disposed loop extending from one end of one rod to one end of the other rod.

15. The guitar stand of claim 14, wherein the rode lie in a first plane, the loop lies in a second plane, and the first plane is transversely oriented with respect to the second plane.

16. The guitar stand of claim 13, wherein the base member is operable to attach to the plane such that the aperture is substantially vertically oriented, the protrusion being at least one of upwardly and downwardly insertable into and through the aperture.

17. The guitar stand of claim 16, wherein the base member includes an engagement bar spaced away from the plane and defining at least a portion of the aperture, the protrusion being biased against the engagement bar when downward force is applied to the distal ends of the rods.

18. A guitar stand, comprising:

a base member operable to attach to a substantially vertically oriented plane, the base member including an engagement bar spaced away from the plane and forming a substantially vertically oriented aperture with the plane; and a hanger member including two spaced apart substantially longitudinally disposed rods, the rods having respective ends terminating at a coupling portion and respective distal ends defining an opening region for receiving a guitar neck, wherein the coupling portion is operable to engage the aperture such that the hanger member removably connects to the base member, the rods extending outward from the plane when the coupling portion engages the aperture.

19. The guitar stand of claim 18, wherein the coupling portion forms a protrusion extending transversely with respect to a plane defined by the rods, the protrusion being receivable into the aperture of the base member.

20. The guitar stand of claim 19, wherein the protrusion is formed by a transversely disposed loop extending from one end of one rod to one end of the other rod.

21. The guitar stand of claim 19, wherein the rods lie in a first plane, the protrusion lies in a second plane, and the first plane is transversely oriented with respect to the second plane.

22. The guitar stand of claim 18, wherein the protrusion is at least one of upwardly and downwardly insertable into and through the aperture.

23. The guitar stand of claim 22, wherein the protrusion is biased against the engagement bar when downward force is a lied to the distal ends of the rods.

* * * * *